US011812899B2

(12) United States Patent
Larsson

(10) Patent No.: US 11,812,899 B2
(45) Date of Patent: Nov. 14, 2023

(54) DISPENSER AND STACK OF SHEET PRODUCTS

(71) Applicant: ESSITY HYGIENE AND HEALTH AKTIEBOLAG, Gothenburg (SE)

(72) Inventor: Björn Larsson, Billdal (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 75 days.

(21) Appl. No.: 16/937,313

(22) Filed: Jul. 23, 2020

(65) Prior Publication Data

US 2021/0068596 A1 Mar. 11, 2021

Related U.S. Application Data

(63) Continuation of application No. 14/131,744, filed as application No. PCT/EP2011/061938 on Jul. 13, 2011, now Pat. No. 10,758,096.

(51) Int. Cl.
*A47K 10/42* (2006.01)
*B65H 45/24* (2006.01)

(52) U.S. Cl.
CPC ..... *A47K 10/42* (2013.01); *A47K 10/426* (2013.01); *B65H 45/24* (2013.01)

(58) Field of Classification Search
CPC ..... A47K 10/42; A47K 10/426; B65H 45/24
USPC ..... 221/119, 121, 120, 167, 122, 143, 259, 221/277; 492/30, 38, 33, 34; 242/564.5
See application file for complete search history.

(56) References Cited

U.S. PATENT DOCUMENTS 1,925,144 A 9/1933 Kuhne
2,809,082 A 10/1957 Marcuse et al.
4,494,747 A * 1/1985 Graef ..... B65H 7/12 221/21
4,516,711 A 5/1985 Barege
4,614,632 A * 9/1986 Kezuka ..... B29C 51/22 425/363
4,779,861 A * 10/1988 Ozawa ..... B65H 3/06 271/119
4,861,013 A * 8/1989 Shibata ..... B65H 3/5261 271/119

(Continued)

FOREIGN PATENT DOCUMENTS

EP 0302382 A1 2/1989
EP 0933053 A2 8/1999

(Continued)

OTHER PUBLICATIONS

An English Translation of the Office Action (Decision on Grant) dated Apr. 29, 2015, by the Russian Patent Office in corresponding Russian Patent Application No. 2014105168/13. (7 pages).

(Continued)

*Primary Examiner* — Rakesh Kumar
(74) *Attorney, Agent, or Firm* — BUCHANAN INGERSOLL & ROONEY PC

(57) ABSTRACT

A dispenser and a stack combination. A dispenser that contains a stack of sheet products and which defines a dispensing path from a product reservoir containing and holding the stack to a dispensing opening through which the sheet products are dispensed. A stack of interfolded webs wherein the lines of weakness of one web are offset from the lines of weakness of another web in a longitudinal direction.

17 Claims, 3 Drawing Sheets

(56) References Cited

U.S. PATENT DOCUMENTS

| | | | | | |
|---|---|---|---|---|---|
| 5,033,620 | A | | 7/1991 | De Luca | |
| 5,061,232 | A | * | 10/1991 | Bloch | A47K 10/34 493/395 |
| 5,098,078 | A | * | 3/1992 | Nakanishi | B65H 3/0653 271/265.04 |
| 5,372,359 | A | * | 12/1994 | Miura | B65H 3/0638 271/119 |
| 5,375,785 | A | * | 12/1994 | Boone | A47K 10/3656 242/560.1 |
| 5,604,992 | A | * | 2/1997 | Robinson | A47K 10/485 242/560 |
| 5,882,004 | A | * | 3/1999 | Padget | B65H 3/0638 271/902 |
| 5,975,518 | A | * | 11/1999 | Wakana | B65H 3/0661 271/121 |
| 6,070,867 | A | * | 6/2000 | Tsurumi | B65H 3/0669 271/157 |
| 6,186,490 | B1 | * | 2/2001 | Sugiura | B65H 3/0638 271/120 |
| 6,213,346 | B1 | | 4/2001 | Skerrett et al. | |
| 6,228,454 | B1 | | 5/2001 | Johnson et al. | |
| 6,311,819 | B1 | * | 11/2001 | Stromme | G07D 7/003 194/207 |
| 6,464,120 | B1 | | 10/2002 | Johnson et al. | |
| 6,520,408 | B1 | * | 2/2003 | Force | G07F 19/201 235/379 |
| 6,655,679 | B2 | * | 12/2003 | Boucher | B65H 5/068 271/9.01 |
| 7,144,006 | B2 | * | 12/2006 | Graef | B65H 3/0653 271/119 |
| 7,182,329 | B2 | | 2/2007 | Graef et al. | |
| 7,191,657 | B2 | * | 3/2007 | Maier | G07D 7/20 73/159 |
| 7,195,237 | B2 | | 3/2007 | Graef et al. | |
| 7,344,132 | B2 | | 3/2008 | Graef et al. | |
| 7,954,405 | B2 | | 6/2011 | Kling | |
| 8,899,508 | B2 | | 12/2014 | Hjort et al. | |
| 2001/0000737 | A1 | | 5/2001 | Johnson et al. | |
| 2001/0020626 | A1 | | 9/2001 | Skerrett et al. | |
| 2002/0155246 | A1 | | 10/2002 | Johnson et al. | |
| 2003/0121970 | A1 | | 7/2003 | Force et al. | |
| 2003/0201274 | A1 | | 10/2003 | Taylor et al. | |
| 2004/0124203 | A1 | | 7/2004 | Phelps et al. | |
| 2006/0065095 | A1 | * | 3/2006 | Ambrose | A47K 10/38 225/93 |
| 2007/0236110 | A1 | | 10/2007 | Kling | |
| 2008/0121649 | A1 | | 5/2008 | Kistner | |
| 2010/0006586 | A1 | | 1/2010 | Granger | |
| 2011/0036855 | A1 | | 2/2011 | Petocchi et al. | |
| 2011/0089213 | A1 | | 4/2011 | Granger | |
| 2011/0101020 | A1 | * | 5/2011 | Granger | A47K 10/424 221/45 |
| 2011/0210137 | A1 | | 9/2011 | Kling | |
| 2013/0105614 | A1 | | 5/2013 | Hjort et al. | |
| 2014/0209624 | A1 | * | 7/2014 | Larsson | A47K 10/426 221/45 |
| 2015/0282679 | A1 | * | 10/2015 | Larsson | A47K 10/3643 221/26 |

FOREIGN PATENT DOCUMENTS

| | | | | | |
|---|---|---|---|---|---|
| EP | 1559355 | A1 | | 8/2005 | |
| FR | 2539726 | A2 | | 7/1984 | |
| FR | 2932671 | A1 | * | 12/2009 | A47K 10/424 |
| RU | 2009131705 | A | | 2/2011 | |
| WO | 9858864 | A1 | | 12/1998 | |
| WO | 0000072 | A1 | | 1/2000 | |
| WO | 2006054966 | A1 | | 5/2006 | |
| WO | 2006071148 | A1 | | 7/2006 | |
| WO | 2007000153 | A1 | | 1/2007 | |
| WO | 2007068883 | A1 | | 6/2007 | |

OTHER PUBLICATIONS

International Search Report (PCT/ISA/210) dated Feb. 7, 2013, by the European Patent Office as the International Searching Authority for International Application No. PCT/EP2011/061938.

Notification of Transmittal of the International Preliminary Report on Patentability (Forms PCT/IPEA/416 and PCT/IPEA/409) dated Feb. 7, 2014, in the corresponding International Application No. PCT/EP2011/061938. (7 pages).

Response to the second Written Opinion for PCT/EP2011/061938, dated Dec. 19, 2013. (9 pages).

Written Opinion (PCT/ISA/237) dated Feb. 7, 2013, by the European Patent Office as the International Searching Authority for International Application No. PCT/EP2011/061938.

Written Opinion (PCT/ISA/237) dated Oct. 30, 2013, by the European Patent Office as the International Searching Authority for International Application No. PCT/EP2011/061938.

* cited by examiner

DISPENSER AND STACK OF SHEET PRODUCTS

CROSS REFERENCE TO RELATED APPLICATIONS

The present application is a continuation of U.S. application Ser. No. 14/131,744, filed on Jan. 9, 2014, which is a U.S. National Stage of International Application No. PCT/EP2011/061938, filed on Jul. 13, 2011. The entire contents of each of U.S. application Ser. No. 14/131,744 and International Application No. PCT/EP2011/061938 are hereby incorporated herein by reference in their entirety.

TECHNICAL FIELD

The present disclosure is concerned with a dispenser that contains a stack of sheet products and which defines a dispensing path from a product reservoir containing and holding the stack to a dispensing opening through which the sheet products are dispensed.

BACKGROUND

US 2011/0101020 A1 discloses a dispensing apparatus for dispensing pre-cut wipe materials provided in the form of a stack of accordion pleated web material. The web material is pre-cut in order to define separable wipe products. This document discloses the dispenser as including a container providing a lower horizontal platform upon which a stack of web material rests during dispensing. When the container is to be refilled with a spare stack of web material, the existing stack of web material is moved so as to come into engagement with an upper horizontal surface and the spare stack of material is positioned behind the existing stack of material in the dispensing sequence. To ensure continuity between the stack of material which is presently in use and the spare stack of material when the material is pulled on by an operator, the two stacks are joined together by means of a joining so that the last fold of material in the existing stack is joined to the first fold of material in the spare stack.

The lower horizontal platform is provided at a bottom of the dispenser and the dispenser is oriented so that the weight of the stack rests on the lower horizontal platform. At an upper part of the dispenser, there is provided a convex or rounded shape member that supports and allows movement of a leading portion of the pre-cut accordion pleated web material from a top of the stack to a dispensing opening positioned at a bottom part of the dispenser. The dispenser is configured so that the weight of the stack does not bare on the leading portion of web material that is being dispensed through the dispensing opening, and thus can be considered a dispenser in which upward dispensing of the web material is enabled. This can be advantageous because the web material being dispensed is not loaded on by the weight of the stack and thus there is less chance of unintended product tearing. Further, in prior art dispensers in which the weight of the stack is placed on the web being dispensed, there is a greater chance of a user grasping a plurality of sheet products when only one is intended because the stack becomes increasingly compressed at the bottom under the weight of the remainder of the stack on top of it.

While the upwards dispensing operation of US 2011/0101020 A1, and other upwards dispensing dispensers (such as U.S. Pat. No. 4,516,711 and WO 2006/071148 A1) may be desirable for the reasons given above, there is a tendency for the web being dispensed to tear at a location along the dispensing path before the web passes the dispensing opening, which makes dispensing of a subsequent sheet product difficult, if not impossible, without opening a case of the dispenser. With a view to this difficulty, US 2011/0101020 A1 proposes cooperating protruding curved shapes for engaging on opposed major surfaces of the web being dispensed that are disposed around a dispensing opening. Despite these measures, a problem may well persist of a user not being presented with a subsequent sheet to grasp at the dispensing opening. It is an object of the present disclosure to address this issue in a simple and reliable manner.

Further, in US 2011/0101020 A1, when the container of the dispenser is full from the horizontal platform at the bottom of the container to an upper horizontal plate, the convex or rounded shape member for supporting and allowing movement of the web material does not engage or does not fully engage with the web material as the top of the stack will be positioned above the convex or rounded shape member, which thus does not fulfil its function during all container fill conditions of the dispenser. This may provide inconsistent dispensing performance. Embodiments of the present disclosure also serve to overcome this problem.

SUMMARY

In one aspect of the disclosure, there is provided a dispenser, comprising:

- at least one stack of interfolded webs, wherein the stack comprises:
- a first elongate web divided into sheet products defined between longitudinally separated lines of weakness extending across the first web; and
- a second elongate web divided into sheet products defined between longitudinally separated lines of weakness extending across the second web;
- wherein the first and second webs are interfolded to form the stack so that the lines of weakness of the first web are offset from the lines of weakness of the second web in a longitudinal direction of the first web;
- a housing defining a product reservoir, wherein the at least one stack of interfolded webs is contained in the product reservoir;
- a dispensing opening;
- wherein a leading portion of the first and second webs of the stack is supported in a dispensing path from the product reservoir to the dispensing opening;
- wherein the weight of the stack is downwardly oriented to bare against a bottom of the stack and the leading portion of the first and second webs extends from a top of the stack.

According to the dispenser and stack combination of an embodiment of the present disclosure, both top of the stack dispensing operation is utilized and offset webs are installed. In an embodiment, the leading portion may extend upwardly from the top of the stack. The upward or top dispensing means that the weight of the stack does not bare against the sheet(s) traversing the dispensing path. This is greatly advantageous because sheet tearing at unintended locations is less likely even for very large weight stacks or multiple stacks. This synergistically combines with the use of offset webs as the multiple webs tend to support one another, preventing unintended tearing of the dispensable products. Thus, larger stack dispensers can be realized with the previously incompatible combined benefit of reduced likelihood of unintended sheet tearing.

A further advantage is that the offset webs alternatingly provide protruding pull tab portions graspable at the dispensing opening as a natural consequence of appropriately dispensing interfolded webs with offset lines of weakness relative to one another.

In an embodiment, there is provided a first nip at or adjacent the dispensing opening that is engaging opposing major surfaces of the webs so that when a user pulls a more advanced one of the webs in the dispensing direction, a sheet product of another of the webs is pulled to partly pass through the first nip and when a sheet product of the one of the webs wholly passes through the first nip, the sheet product of the one of the webs tears away at the line of weakness that has passed through the first nip to leave the first nip engaging on opposed major surfaces of the webs and the other of the webs more advanced in the dispensing direction than the one of the webs. Dispensing proceeds in this manner so that a portion of one of the webs is alternating more advanced from a portion of another of the webs.

In an embodiment, the first nip is provided by first and second rollers respectively engaging the opposed major surfaces of the webs.

Rollers are conveniently configurable to provide the right amount of pinch force to ensure smooth dispensing, while still making sure that the sheet products tear away at the lines of weakness once they pass through the first nip.

The first nip further provides resistance to fall back of the webs, which is necessary in view of the weight of at least part of the leading portion being directed against the upward dispensing path and thus tending to force fall back of the leading portion to the stack.

In an embodiment, there is provided a second nip along a dispensing path traversed by the leading portion of the webs from the product reservoir to the first nip, wherein the second nip engages opposed major surfaces of the webs.

In an embodiment, the first nip is released upon opening a door to refill the product reservoir. In such instances, the presence of a second, upstream nip is useful to make sure that web fall back does not occur during refilling.

In an embodiment, there is provided a blocking surface for blocking the at least one stack from extending above the blocking surface in the dispensing path. In an embodiment, the webs pass above the blocking surface in the dispensing path.

Thus, the dispenser of an embodiment of the present disclosure provides an upwardly extending dispensing path even when the product reservoir is filled to a limit defined by the blocking surface. This feature ensures consistent dispensing operation whether the dispenser is filled to the limit or in a depleted condition since the webs always have to extend upwardly.

In an embodiment, the webs extend upwardly from the top of the stack, are supported at an apex portion of the dispensing path and then extend downwardly to the dispensing opening. In an embodiment, the apex portion of the dispensing path is positioned above the top of the product reservoir and the dispensing opening is positioned below the top of the product reservoir. The top of the product reservoir may be defined by the blocking surface described above. In such embodiments, the upward dispensing effect is achievable, and yet the dispenser can be made tall with flexibility as to the positioning of the dispensing opening as a result of the webs extending down from the apex portion of the dispensing path. In an embodiment, the second nip is provided at the apex portion of the dispensing path. This ensures that web fallback does not occur at a position where it could be most detrimental to reclaiming the product since product slippage beyond the apex portion could result in the webs returning to the stack, which will require reloading of the dispenser in the dispensing path.

In an embodiment, the dispensing path is defined by at least one guide member supporting the webs in the dispensing path. In an embodiment, a guide member defines a curved apex portion about which the webs are wrapped in transition from an upwardly extending part of the webs to a downwardly extending part of the webs along the dispensing path to the dispensing opening. In an embodiment, at least part of the at least one guide member engages on one major surface of the webs along a length of the webs so that the opposed major surface is free from engagement thereby along the length. In an embodiment, the part of the guide member is a planar part extending down so as to define a substantially freely hanging portion of the webs. This configuration of the guide member or members ensures that the webs are moved along the dispensing path with a minimum of resistance.

In an embodiment, a guide member defines a protruding portion of the dispensing path so that the dispensing path extends in a direction normal to the stacking direction of the dispenser (or the bottom to top direction) so that a portion of at least one of the webs hangs spaced from a front wall of the dispenser in the normal direction at the dispensing opening. This presents the web in a grasp friendly manner for a user.

In an embodiment, a guide member defining an apex portion of the dispensing path from the product reservoir to the dispensing opening forms one part of the second nip engaged against one major surface of the webs and a second part of the nip opposed to first part of the nip engages the opposed major surface of the webs to thereby grasp the web at the an apex portion of the dispensing path. Thus, the guide member is conveniently used to form part of the second nip. In an embodiment, the second nip engages against the major surfaces of the webs to resist the web moving backwards along the dispensing path (away from the dispensing opening towards the product reservoir) and is configured to, upon movement of the webs forwardly along the dispensing path, to release a nip force on opposed major surfaces of the web to allow the web to move forwardly. In an embodiment, the second part is formed by a pivotable member that rests against the major surface of the webs to resist the web moving backwards along the dispensing path (away from the dispensing opening towards the product reservoir) and which is pivotable upon movement of the webs forwardly along the dispensing path to release a nip force on opposed major surfaces of the web.

In a further embodiment, the webs extend between the first and second nips so as to be engaged by a guide member on just one of the opposed major surfaces of the webs along any given lateral line or hangs freely so that neither major surface of the webs is engaged along the portion extending between the first and the second nips. This feature serves to reduce dispensing resistance to avoid unintended tearing of the webs.

In an embodiment, the dispenser is configured so that a preceding stack in the product reservoir has to be lifted up in the product reservoir to position a new, succeeding stack in the product reservoir underneath the preceding stack.

In an embodiment, the product housing may comprise a front wall, which may be revealed by opening a refill door of the dispenser, that partly covers a front side of the stack of interfolded webs and is partly open to allow access to the stack. The access opening may be large enough to permit a user's hand to be inserted to grasp the stack. In an embodiment, the opening extends in the stacking direction from a bottom of the product reservoir so that a bottom of a lowermost stack in the product reservoir can be grasped to a position at least as high as the amount of space needed to accommodate a new, full stack. In an embodiment, the opening extends at least 25% of the height of the product reservoir in the stacking direction, at least 50%, or at least 75%, or the opening extends all the way from top to bottom of the product reservoir. The front wall may include first and second wall parts covering a front side of the stack at opposed ends of the front side of the stack that are spaced crosswise apart with respect to the stacking direction to provide the opening extending in the stacking direction.

The access opening allows a maintenance attendant to conveniently lift the bottom stack by hand to insert a new one, while the closed part of the front wall ensures that the product housing suitably conforms to the stack to hold the stack securely in the product housing.

In an embodiment, the lines of weakness are formed by openings through the web, such as slits, and connecting parts, such as connecting tabs, wherein the lines of weakness have an average ratio of connecting parts to spaces of 4/100 to 8/100 or 5/100 to 7/100 and preferably 6/100. These ratios are greater than is conventional (e.g. 2/100), which provides increased strength to allow the webs to be dispensed upwardly without the lines of weakness coming apart before they are supposed to. The increased strength has been found not to compromise on unintended tearing of the webs because of the natural supporting effect of the interfolded webs, which has been found to encourage tearing only at the designated lines of weakness even with the increased strength lines of weakness specified above.

In an embodiment, the product reservoir comprises a plurality of such stacks of interfolded, offset webs and adjacent stacks are joined to one another so that pulling the webs through the dispensing path of a preceding stack pulls through the webs of a succeeding stack as a result of a joint at the interface of the two stacks. In an embodiment, the joint is provided by an adherence layer, such as an adhesive strip, hook and loop fastener, or other such means.

In a second aspect of the disclosure, there is provided a system of a dispenser as defined above and a new stack of interfolded webs having offset lines of weakness along the webs, wherein the new stack comprises an adherence layer for joining the webs of a stack in the product reservoir of the dispenser to the webs of the new stack, wherein the adherence layer includes a release part that is to be removed to reveal underlying adherence material for joining the webs of the new stack to the webs of the stack in the product reservoir.

In embodiments, the interfolded webs define sheet products for wiping, such as paper towel sheet products, napkin sheet products, wet wipe sheet products, or the like.

BRIEF DESCRIPTION OF THE DRAWINGS

The present disclosure will be described in more detail below, with reference to the Figures, in which:

FIG. 3 shows a leading portion of the web in the dispensing path, which will protrude from the dispensing opening when the door is closed.

DETAILED DESCRIPTION OF EMBODIMENTS

Figure 1:
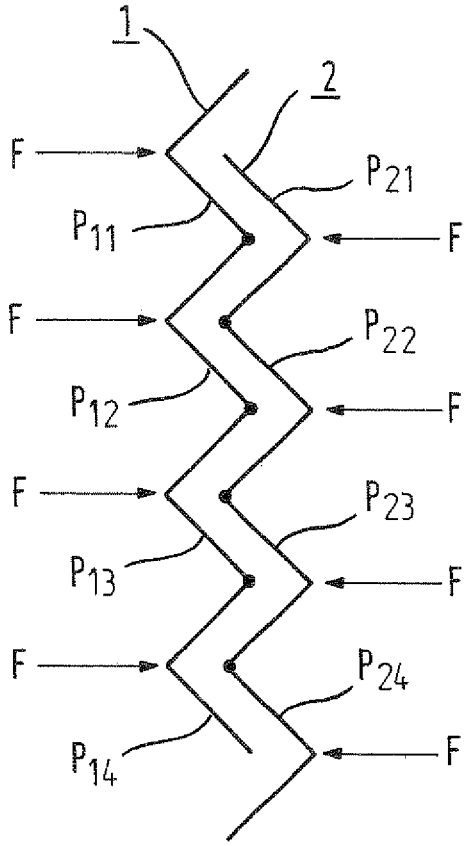
FIG. 1 shows an exemplary arrangement of interfolded webs wherein the lines of weakness of one web are offset from the lines of weakness of another web in a longitudinal direction. The figure is highly schematic for the purposes of illustrating the interfolding pattern and the locations of the lines of weakness along the webs.

FIG. 1 shows first and second webs 1, 2 that are interfolded with one another so that the lines of weakness indicated by the filled-in dots are longitudinally offset for one web as compared to the other. The fold locations are indicated by the letter F. The first and second webs 1, 2 are folded with laterally extending fold lines so that the webs together are compressed into an accordion like state to form a stack of interfolded webs. The fold lines for the first web 1 and the fold lines for the second web 2 are longitudinally coincident with respect to the longitudinal direction of the webs 1, 2.

The lines of weakness for a given web 1, 2 extend laterally and define longitudinally extending separable products $P_{WN}$ between adjacent lines of weakness (where W stands for the web number and N stands for the product number counted consecutively starting from the leading product). The laterally extending fold lines F divide the products $P_{WN}$ into a certain number of panels M. In the shown embodiments each product $P_{WN}$ is composed of two panels divided by a fold line F. In the embodiments shown in FIG. 1, the lines of weakness of each web are longitudinally aligned with a fold line F in the other web.

The webs 1, 2 in FIG. 1 are shown in a longitudinally more straightened configuration then they would be when compressed. In the natural compressed state of the stack, each panel of one web lies flat against an adjacent panel of the other web. A more realistic representation of what a stack of interfolded, offset webs will look like is shown in FIGS. 2 and 3, with respect to reference signs 5, 6, 7, 8.

The present disclosure is not limited to the particular interfolded configuration shown in FIG. 1. For example, it is envisaged that each product P could be divided into one, two, three or more panels. The number of webs could be greater than the two shown. For example, stacks with three, four or more interfolded, offset webs could be provided in the dispenser and stack combination of an embodiment of the present disclosure. Yet further, the lines of weakness of one web do not have to be longitudinally aligned with a fold line of the other web. Thus, the lines of weakness in each web could be provided between fold lines in the other web, such as half way between, or otherwise. Each stack could include at least 100 sheet products $P_{WN}$, at least 200, at least 300, at least 400, at least 500, at least 1000 and even at least 2000 sheet products.

The dispenser and stack combination according to an embodiment of the present disclosure will now be described.

Figure 2:
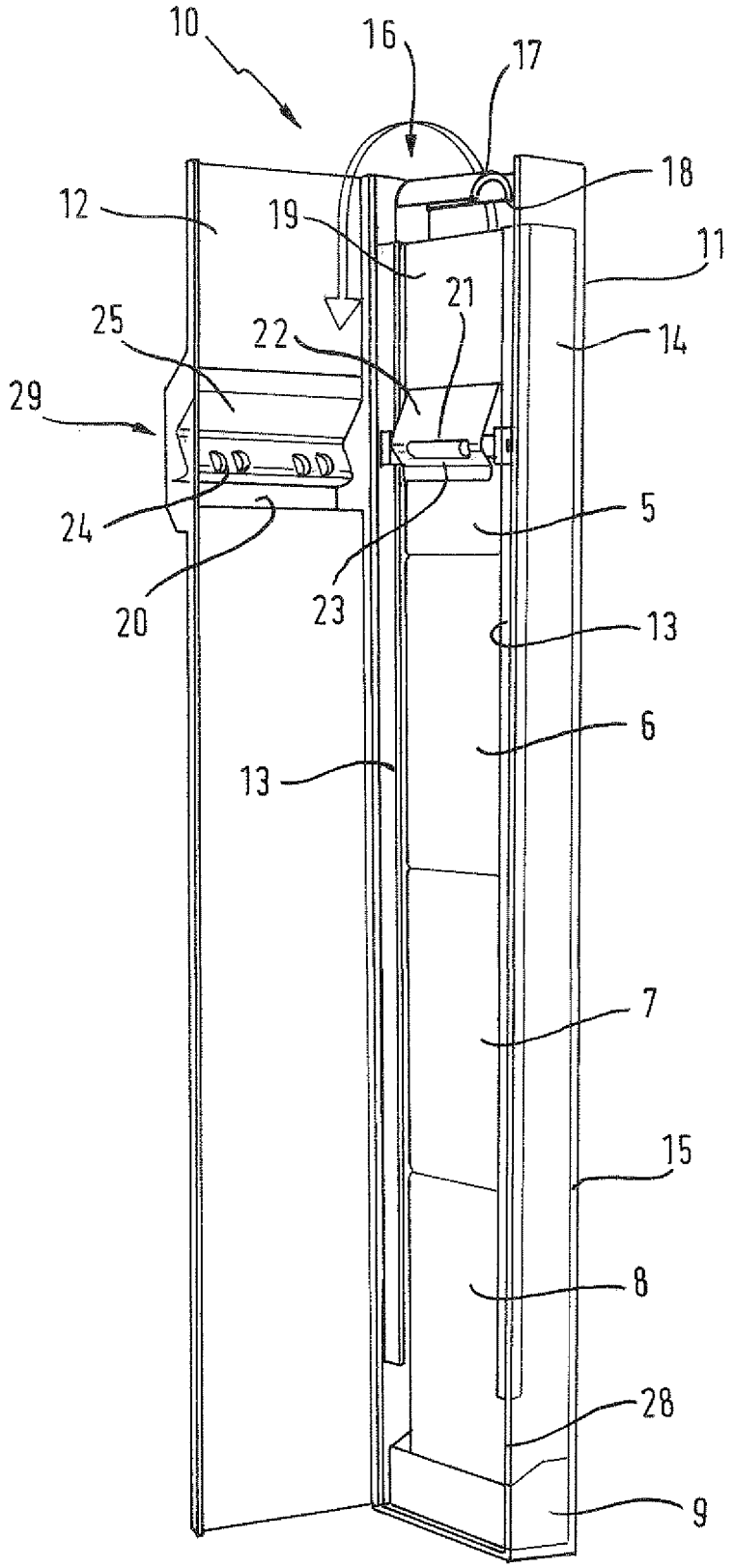
FIG. 2 shows an embodiment of a dispenser according to an embodiment of the present disclosure. The dispenser is shown in a substantially full state with a leading portion of the stack not yet positioned in a dispensing path and not yet positioned adjacent to a dispensing opening. The dispenser is shown in an open state in which a door of a dispenser is open to allow for filling and loading the dispenser ready for dispensing.
Figure 3:
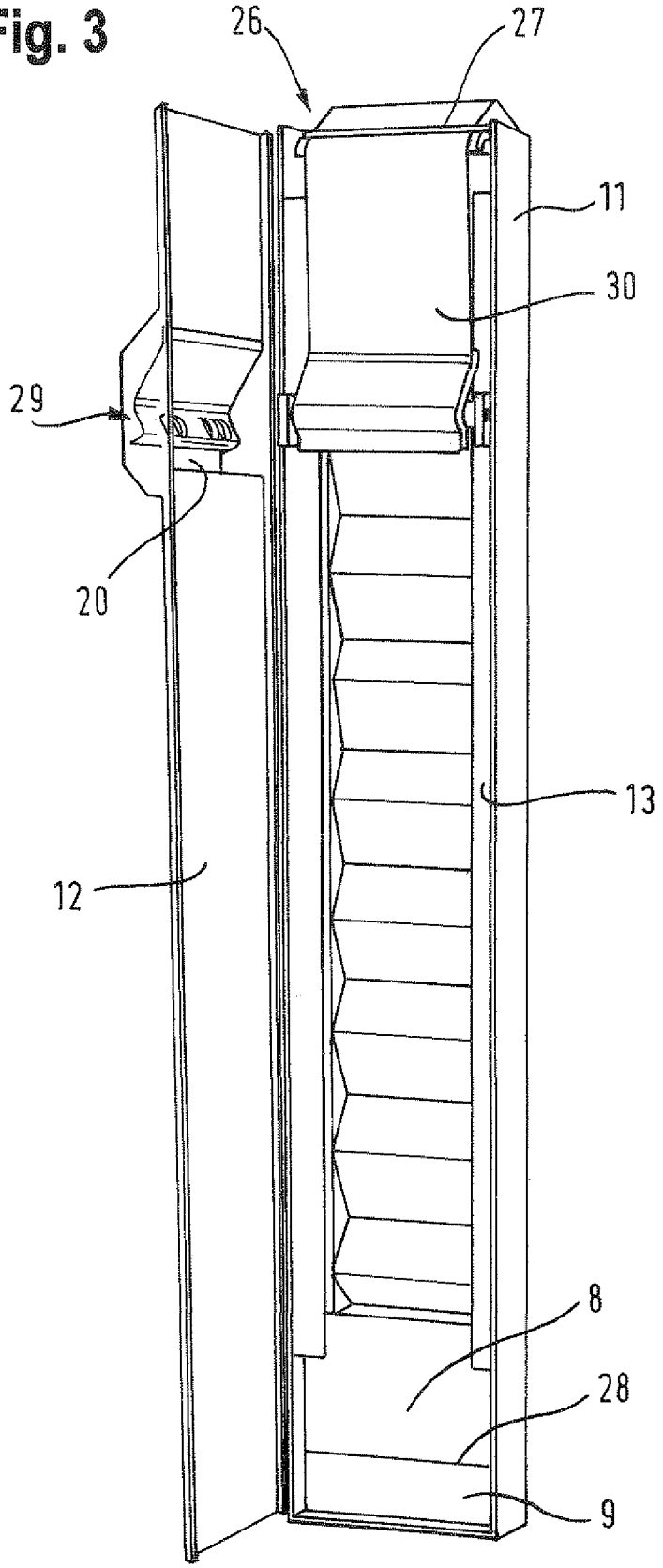
FIG. 3 shows the dispenser of FIG. 2 in which a product reservoir is in a significantly more depleted state.

FIG. 2 shows a dispenser 10 comprising a product housing 11 defining an interior area forming a product reservoir for containing at least one, preferably a plurality, of stacks 5, 6, 7, 8 of interfolded, offset webs. The product housing 11 defines a front wall 13, a rear wall 15 and first and second sidewalls 14 connecting the front wall 13 and the rear wall 15. These walls 13, 14, 15 together define an interior area for containing the plurality of stacks 5, 6, 7, 8. The walls 13, 14 and 15 are shaped so as to fit with the cross sectional dimensions of the stacks 5, 6, 7, 8 when the cross section is taken across the stacking direction.

The front wall 13 is partially open in that it defines an opening extending in a stacking direction between opposed front wall parts that are respectively connected to first and second sidewalls 14. The rear wall 15 and the first and second sidewalls 14 cover respective sides of the stacks 5, 6, 7, 8, whereas the front wall only partly covers a front side of the stacks 5, 6, 7, 8. This partially open front wall is useful for loading the stacks 5, 6, 7, 8 into the interior area defined by the product housing 11, as will be discussed in more detail below.

The product housing 11 further comprises a base member 12 against which the weight of the stacks 5, 6, 7, 8 rests and which forms a bottom wall of the interior area defined by the product housing 11. A top of the product housing 11 is at least partly open so that a leading portion of the stacks 5, 6, 7, 8 can be fed from the interior area defined by the product housing 11 to a dispensing path and ultimately to a dispensing opening 20 detailed below.

The dispenser 10 further comprises a guide member 16. The guide member 16 defines the dispensing path from a top of the interior area defined by the product housing 11 upwardly and over an apex portion 17 of the guide member 16 and then downwardly along a relatively planar portion 19 of the guide member 16 extending substantially directly downwardly, through a nip 29 and finally into a dispensing opening 20. The guide member 16 defines a blocking surface 18 that projects into the interior area defined by the product housing 11 so that the product housing 11 cannot be filled upwardly beyond the blocking surface 18. From the blocking surface 18, the guide member 16 transitions into an apex portion 17 that is curved so that a leading portion of the first and second webs can smoothly traverse an upwardly extending portion of the dispensing path to a downwardly extending portion of the dispensing path. The downwardly extending portion of the dispensing path is defined at least in part by a substantially planar portion 19 of the guide member 16 that extends directly downwardly so as to be parallel to the front wall of the product housing 11. An end of the apex portion 17 of the guide member 16 transitions into the planar portion 19. The guide member 16 transitions from the planar portion 19 into a portion 22 projecting away from the front wall 13 of the product housing 11 toward the dispensing opening 20, wherein a first part 21 of a dispensing opening nip 29 is disposed on the projecting portion 22. After the nip part 21, the guide member 16 defines at its end a curved chute portion 23 that curves so that webs hanging in the downward direction are diverted outwardly through the dispensing opening 20. In particular, the chute portion 23 curves from an orientation extending downwardly, or parallel to the front wall 13 of the product housing 11, to a configuration pointing outwardly from the front wall 13 to the dispensing opening 20.

The guide member 16 covers at least a majority of a front side of the stacks 5, 6, 7, 8, which is to say it extends laterally along at least most of the width of the front wall of the stacks 5, 6, 7, 8 (where the length of the stack is to be taken in the stacking or dispensing direction), to thereby support and guide the webs 1, 2 across the webs lateral extent as the webs traverse the dispensing path defined by the guide member 16.

The dispenser 10 further comprises a door 12 that is hingedly mounted with respect to the product housing 11 and the guide member 16 between an open configuration in which the product housing 11 can be filled or refilled and a closed position for normal dispensing. FIGS. 2 and 3 show the door 12 in the open position. The door 12 is hingedly mounted with respect to the product housing 11 so that a rotation axis extends in a stacking direction of the dispenser and so that in the open configuration, the open space defined between the opposed parts of the front wall 13 is exposed.

The door 12 defines the dispensing opening 20. Thus, when the door 12 is in the closed position, a user grasps a sheet product and dispenses it through the dispensing opening 20 in the door 12. Secured to the door is a second part 24 of the nip 29 that is positioned opposed to the first part 21 to engage on opposed major surfaces of the leading portion of the webs being dispensed through the dispensing opening when the door 12 is in the closed position. When the door is in the opened position shown, the first and second parts 21, 24 of the nip 29 come apart because the second part 24 of the nip 29 moves with the door 12. This causes a nip force on the webs previously in the nip 29 to be released when the door is in the open position 12 and to be enforced when the door 12 is in the closed position relative to the product housing 11.

The door 12 has a guiding surface 25 mounted to it that cooperates with a projecting part 22 of the guide member 16 to guide the webs away from the front wall 13 of the product housing to a position projecting slightly from the general plane of the door 12 so that with the webs held in the nip 29, a protruding portion of one of the webs hangs in spaced relation in a direction normal to the front wall 13 of the product housing 11 from the door 12 at the dispensing opening 20, which provides an easy to comprehend and easy to physically grasp presentation of the protruding portion of the webs for dispensing through the dispensing opening 20.

In FIG. 3, a second nip 26 is illustrated, which is pivotally mounted to the product housing 11 so that a bar 27 opposes the apex portion 17 of the guide member 16, whereby the apex portion 17 and the bar 27 form opposed parts of the nips 26 for respectively engaging on opposed major surfaces of the first and second webs. The rod 27 is pivotable to release a nip force of the nip 26 to allow the first and second webs to move forwardly in the dispensing direction, but serve to resist movement of the first and second webs backwardly in the dispensing direction.

In FIG. 3, a leading portion 30 of the first and second webs can be seen as extending over the guide member 16 beyond the first nip 29 to provide at least one of the first and second webs projecting at the dispensing opening for grasping by the user when the door 12 is in the closed position. In the substantially depleted state of the product housing 11, the stack 8 rests against the base 9, while the leading portion 30 extends from a top of the stack 8 at a bottom of the product housing 11, up through a majority of the length of the product housing 11 in the stacking direction (or the dispensing direction) to a position passing over an apex portion 17 of the guide member 16 along the dispensing path defined by the guide member 16 to the dispensing opening 20 as previously described. In the substantially depleted state, the stack 8 defines a compressed accordion structure where the panels lie parallel with one another, whereas the part of the leading portion that extends from the bottom of the product housing 11 defines an extended accordion structure, where an angle between the panels is extended to greater than 90° and toward 180° in order to allow the leading portion 30 to bridge the gap between the stack 8 and the apex portion 17. The lines of weakness in the leading portion 30 are thus weighted down by the first and second webs 1, 2 lifted away from the stack 8 which rests against the base 9. It is for this reason that increased strength lines of weakness as described above has been made use of.

An operation of refilling and filling the dispenser 10 will now be described.

The door 12 is moved to the open position so as to expose the front wall 13 of the product housing 11 and the central space that extends laterally between opposed parts of the front wall 13 and which extends in a stacking direction from a bottom to a top of the product housing 11.

When the door 12 is opened, the first nip 29 is released, which could cause the leading portion 30 to fall back into the product housing 11 and crumple on to the top of the stack 8 because the majority of the weight of the leading portion 30 lies inside the product housing 11 and behind the apex portion 17 of the guide member 16 along the dispensing path. In order to prevent such web fallback, the second nip 26 is provided, which nips the first and second webs 1, 2 of the leading portion 30 even when the door 12 is in the open position.

Assuming the product housing 11 is empty, a first stack 5, 6, 7, 8 can be fed through a filling opening 28 defined between a bottom of the front wall 13 and the base 9. A second stack 5, 6, 7, 8 can be positioned in the interior area defined by the product housing 11 by lifting the previous stack upwardly to create room to accommodate the next stack.

A stack can be lifted by hand using the space between the first and second parts of the front wall 13. This process of lifting and inserting can be repeated until the product reservoir defined by the walls 13, 14 and 15 of the product housing 11 is filled.

An attendant then takes first and second webs 1, 2 from a top of the stacks 5, 6, 7, 8, passes the webs over the apex portion 17 of the guide member 16 and positions the first and second webs 1, 2 along the guide member 16 so as to extend beyond the first part 21 of the nip 29. The door 12 is then closed so that the second part 24 of the nip 29 is brought into an opposed position with the first part 21 of the nip 29 so that opposed major surfaces of the first and second webs 1, 2 are engaged by the nip 29. With the door member 12 closed and the first nip 29 engaged, part of the first and second webs 1, 2 will project beyond the first nip 29 and at least one of those webs 1, 2 will be exposed for grasping at the dispensing opening 20.

With reference to FIG. 3, a refilling operation will be described with the product reservoir defined by the housing 11 being substantially depleted. In FIG. 3, it is shown that just one partial stack 8 is remaining in the interior area or product reservoir defined by the product housing 11.

In order to insert a new stack, the present stack 8 shown in FIG. 3 is lifted from the base 9 by hand making use of the space between the laterally spaced front walls 13. The new stack is inserted in the opening between the bottom of the front wall 13 and the base 9 with the previous stack 8 in a position lifted far enough up the product housing to accommodate the new stack.

An operation of dispensing sheet products of the first and second sheets 1, 2 will now be described. Referring to FIG. 3 and envisaging the door 12 in the closed position, the leading portion 30 will protrude for grasping at the dispensing opening 20. When a user grasps this protruding portion, the user will be grasping one of the first and second webs 1,2, since a natural result of offset lines of weakness of the webs 1,2 is that one of the first and second webs will protrude beyond the other during dispensing in an alternating manner.

Assuming the user is grasping the first web, the user will be grasping a part of a sheet protract $P_{1N}$, wherein the sheet product $P_{1N}$ is part way behind the first nip 29 in the dispensing direction and part way beyond the nip 29 in the dispensing direction. The second web 2 has only a marginal leading portion that protrudes beyond the first nip 29 so that the user will naturally grasp the more advanced, in the dispensing direction, first web 1. As the first web 1 is pulled through the first nip 29, the second web 2 is pulled through with it as a natural consequence of the face to face interaction between the first and second webs 1, 2. Once the remaining part of the sheet product $P_{1N}$ of the first web 1 is pulled marginally beyond the first nip 29, the resistance provided by the first nip 29 is such as to cause tearing of the first web 1 at the line of weakness defining the sheet product $P_{1N}$ to thereby separate the sheet product dispensed for the user. Having carried out this operation, part of a sheet product $P_{2N}$ of the second web 2 will extend through the first nip 29 and be more advanced relative to the marginal leading part of the first web 1 protruding from the first nip 29. The user will thus naturally grasp the second web 2 and the process will be repeated so that a sheet product is alternatingly dispensed from the first web 1 and the second web 2 in a way that provides a protruding portion at the dispensing opening 20 that automatically presents itself and its function for pulling on for further dispensing to the user.

During dispensing of the first and second webs 1, 2, the second nip 26 is released when the webs are moved forward by a pivoting action associated with the rod member 27. When dispensing is ceased, the rod member 27 naturally falls back so as to engage the first and second webs at the second nip 26 to prevent fallback of the leading portion 30 of the webs 1, 2.

The stacks are joinable to one another during the filling or refilling operation in that a bottom of an old stack and/or a top of a new stack is provided with an adherence layer, which joins the webs of the old stack to the webs of the new stack in such a way that as the end of the old stack is pulled into the dispensing path, the webs of the new stack are pulled with it. It may be that an attendant has to release a covering layer in order to expose the adherence material for joining the bottom of one stack to the top of an adjacent stack.

Various alternatives to the embodiments shown in the Figures could be provided, as would be appreciated by the skilled person.

For example, the dispenser shown in the figures is particularly tall so that a plurality of stacks can be positioned together so that the stacking direction of each stack is aligned in the top to bottom direction. In particular, the embodiment shows that four stacks 5, 6, 7, 8 can be accommodated in the dispenser 10. The principles of the present disclosure, namely the synergistic advantages achieved by combining an upward dispensing dispenser with offset interfolded webs, is applicable to other applications, including dispensers that can only contain just over one full stack or can only contain two full stacks or dispensers wherein the stacks are of smaller sizes. For example, if the number of sheet products in the stacks 5, 6, 7, 8 shown in FIGS. 2 and 3 is greater than 1000, we envisage a dispenser that is designed to house two full stacks having between 50 and 200 sheet products in each stack.

In the shown embodiment, the guide member 16 is a single member. We envisage, however, that the guide member 16 could be separated into more than one part, particularly a respective part for each of the parts 17, 18, 19, 22 and 23 described above.

In the embodiments, the first nip 29 is provided by opposed rollers and the second nip is provided by a pivotable bar 27 and an apex portion 17 of the guide member 16. It can be envisaged that the second nip could also be provided by opposed rollers that allow the leading portion 30 of the webs 1, 2 to pass in the forward direction along the dispensing path but to resist movement of the leading portion 30 in the rearward direction along the dispensing path. While rollers are used for the first nip 29, other known nip configurations can be utilized, such as suitably cooperating smoothly curved surfaces.

The invention claimed is:

1. A dispenser, comprising:

at least one stack of interfolded webs, wherein the stack comprises at least two webs, including:

a first elongate web divided into sheet products defined between longitudinally separated lines of weakness extending across the first web; and a second elongate web divided into sheet products defined between longitudinally separated lines of weakness extending across the second web;

wherein the webs are interfolded to form the stack so that the lines of weakness of the first web are offset from the lines of weakness of the second web in a longitudinal direction of the first web;

a housing defining a product reservoir, wherein the at least one stack of interfolded webs is contained in the product reservoir; and a dispensing opening at a front of the housing, the opening extending below a first nip, wherein the housing comprises a front wall forming a front wall of the product reservoir, wherein the front wall has a front wall surface facing the front of the housing, and a rear surface facing a rear of the housing, wherein the front wall surface of the front wall is revealed by opening a refill door of the dispenser when the refill door is opened for refilling the product reservoir, wherein the refill door opens horizontally along a vertical axis, wherein a leading portion of the webs of the stack is supported in a dispensing path from the product reservoir to the dispensing opening, wherein the weight of the stack is downwardly oriented to bare against a bottom of the stack and the leading portion of the first and second webs extends from a top of the stack.

2. The dispenser of claim 1, wherein the leading portion extends upwardly from the top of the stack.

3. The dispenser of claim 1, wherein the first nip is provided at or adjacent the dispensing opening that engages opposing major surfaces of the webs, wherein the first nip has a first nip part and a second nip part, wherein the dispensing path extends between the first nip part and the second nip part.

4. The dispenser of claim 3, comprising a second nip along a dispensing path traversed by the leading portion of the webs from the product reservoir to the first nip, wherein the second nip engages opposed major surfaces of the webs.

5. The dispenser of claim 3, wherein the first nip is released upon opening a door to refill the product reservoir.

6. The dispenser of claim 4, wherein the second nip engages against the major surfaces of the webs to resist the web moving backwards along the dispensing path and is configured to, upon movement of the webs forwardly along the dispensing path, release a nip force on opposed major surfaces of the web to allow the web to move forwardly.

7. The dispenser of claim 1, wherein a guide member comprises a blocking surface, wherein the blocking surface is on an underside of the guide portion, wherein the blocking surface is configured for preventing the at least one stack from extending above the blocking surface in the dispensing path, and wherein the webs pass above the blocking surface in the dispensing path.

8. The dispenser of claim 1, wherein the webs extend upwardly from the top of the stack, are supported at an apex portion of the dispensing path and then extend downwardly to the dispensing opening, with respect to a dispensing direction along the dispensing path.

9. The dispenser of claim 8, wherein the apex portion of the dispensing path is positioned above the top of the product reservoir and the dispensing opening is positioned below the top of the product reservoir.

10. The dispenser of claim 1, wherein the webs are wrapped about a curved apex portion in transition from an upwardly extending part of the webs to a downwardly extending part of the webs along the dispensing path to the dispensing opening.

11. The dispenser of claim 9, wherein a first nip is provided at or adjacent the dispensing opening that engages opposing major surfaces of the webs, wherein the first nip has a first nip part and a second nip part, wherein the dispensing path extends between the first nip part and the second nip part, further comprising a second nip along a dispensing path traversed by the leading portion of the webs from the product reservoir to the first nip, wherein the second nip engages opposed major surfaces of the webs, wherein the second nip is provided at the apex portion of the dispensing path.

12. The dispenser of claim 11, wherein a guide member defining the apex portion of the dispensing path from the product reservoir to the dispensing opening forms one part of the second nip engaged against one major surface of the webs and a second part of the nip opposed to first part of the nip engages the opposed major surface of the webs to thereby grasp the web at the apex portion of the dispensing path.

13. The dispenser of claim 1, wherein the dispensing path is defined by at least one guide member supporting the webs in the dispensing path.

14. The dispenser of claim 1, wherein the dispenser is configured so that a preceding stack in the product reservoir has to be lifted up in the product reservoir to position a new, succeeding stack in the product reservoir underneath the preceding stack.

15. The dispenser of claim 1, wherein a guide member defines an apex portion of the dispensing path so that the dispensing path extends in a direction normal to the stacking direction of the dispenser so that a portion of at least one of the webs hangs spaced from a front wall of the dispenser in the normal direction at the dispensing opening.

16. The dispenser of claim 1, wherein the lines of weakness are formed by openings through the web and connecting parts, wherein the lines of weakness have an average ratio of connecting parts to spaces of 4/100 to 8/100.

17. The dispenser of claim 1, wherein the product reservoir comprises a plurality of the stacks of interfolded, offset webs and adjacent stacks are joined to one another so that pulling the webs through the dispensing path of a preceding stack pulls through the webs of a succeeding stack as a result of a joint at the interface of the two stacks.

* * * * *